US011308835B2

(12) United States Patent
Lee et al.

(10) Patent No.: US 11,308,835 B2
(45) Date of Patent: Apr. 19, 2022

(54) DISPLAY DEVICE AND METHOD OF CONTROLLING DRIVING VOLTAGE THEREOF

(71) Applicant: Samsung Display Co., Ltd., Yongin-si (KR)

(72) Inventors: Yoon Young Lee, Yongin-si (KR); Sung Chun Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 37 days.

(21) Appl. No.: 16/667,208

(22) Filed: Oct. 29, 2019

(65) Prior Publication Data

US 2020/0175906 A1 Jun. 4, 2020

(30) Foreign Application Priority Data

Dec. 3, 2018 (KR) ..... 10-2018-0153595

(51) Int. Cl.
*G09G 3/20* (2006.01)

(52) U.S. Cl.
CPC ..... *G09G 3/20* (2013.01); *G09G 2310/0275* (2013.01); *G09G 2320/02* (2013.01); *G09G 2330/028* (2013.01)

(58) Field of Classification Search
CPC ..... G09G 2330/00–12; G09G 3/2092–2096
See application file for complete search history.

(56) References Cited

U.S. PATENT DOCUMENTS

| | | | | |
|---|---|---|---|---|
| 5,432,336 | A * | 7/1995 | Carangelo | G01J 1/44 250/214 C |
| 8,754,838 | B2 | 6/2014 | Kwon et al. | |
| 9,013,380 | B2 | 4/2015 | Seo et al. | |
| 9,058,773 | B2 | 6/2015 | Park | |
| 2007/0002188 | A1* | 1/2007 | Kumagai | G09G 3/2011 348/751 |
| 2010/0290787 | A1* | 11/2010 | Cox | H04B 10/25753 398/115 |
| 2011/0157127 | A1* | 6/2011 | Jun | G09G 3/3685 345/211 |
| 2018/0108308 | A1* | 4/2018 | Cao | G09G 3/36 |
| 2018/0212513 | A1* | 7/2018 | Park | G01R 31/50 |

FOREIGN PATENT DOCUMENTS

| | | |
|---|---|---|
| KR | 10-2013-0101814 | 9/2013 |
| KR | 10-1338628 | 12/2013 |
| KR | 10-1860739 | 5/2018 |

* cited by examiner

*Primary Examiner* — Hang Lin
(74) *Attorney, Agent, or Firm* — H.C. Park & Associates, PLC

(57) ABSTRACT

A display device includes a display panel to display an image, a data driver to supply a data signal to the display panel, and a power supply to supply a driving voltage to the display panel through a power supply line and to supply a data driving voltage to the data driver, in which the power supply is configured to detect a voltage of the power supply line during an initial driving period during which the data driving voltage is supplied to the data driver, to supply a ground voltage to the display panel when the voltage detected from the power supply line is different from a reference voltage, and to supply the driving voltage to the power supply line after the initial driving period.

18 Claims, 4 Drawing Sheets

DISPLAY DEVICE AND METHOD OF CONTROLLING DRIVING VOLTAGE THEREOF

CROSS-REFERENCE TO RELATED APPLICATION

This application claims priority from and the benefit of Korean Patent Application No. 10-2018-0153595, filed on Dec. 3, 2018, which is hereby incorporated by reference for all purposes as if fully set forth herein.

BACKGROUND

Field

Exemplary embodiments of the invention relate generally to a display device and, more specifically, to a display device and a method of controlling a driving voltage of the same.

Discussion of the Background

In general, a display device has a power management integrated circuit (PMIC) that converts a main power source of the display device into a stable driving voltage and provides the converted driving voltage to a display panel of the display device. The driving voltage stabilized by the PMIC is supplied to a plurality of pixels included in the display panel to cause the plurality of pixels to emit light.

The PMIC provides a short circuit protection (SCP) function to prevent an accident to be caused by an abnormal state of the display panel, such as being burnt due to a short circuit of a power supply line coupled to the display panel. The SCP function includes detecting a short circuit by sensing an abnormal change in a driving voltage while the display panel is driven and shutting down the display panel accordingly.

Since the SCP function of the conventional PMIC is typically performed during driving (or operating) of the display panel, in which the driving voltage is supplied to the display panel, an abnormal state occurs before normal driving. As such, abnormal light emission cannot be prevented from occurring once the display panel is initially driven.

The above information disclosed in this Background section is only for understanding of the background of the inventive concepts, and, therefore, it may contain information that does not constitute prior art.

SUMMARY

Display devices constructed according to exemplary embodiments of the invention and methods for controlling a driving voltage of the same are capable of detecting an abnormal state of a display panel during an initial driving period before a driving voltage is supplied to the display panel and controlling the driving voltage based on the detection result.

For example, an abnormal state of the display panel may be detected during the initial driving period before the driving voltage is provided to the display panel, and the driving voltage may be controlled to prevent abnormal light emission in the display panel during the initial driving period thereof.

Additional features of the inventive concepts will be set forth in the description which follows, and in part will be apparent from the description, or may be learned by practice of the inventive concepts.

A display device according to an exemplary embodiment includes a display panel to display an image, a data driver to supply a data signal to the display panel, and a power supply to supply a driving voltage to the display panel through a power supply line and to supply a data driving voltage to the data driver, in which the power supply is configured to detect a voltage of the power supply line during an initial driving period during which the data driving voltage is supplied to the data driver, to supply a ground voltage to the display panel when the voltage detected from the power supply line is different from a reference voltage, and to supply the driving voltage to the power supply line after the initial driving period.

The power supply may include a voltage converter to generate the data driving voltage by converting an external input voltage, and a driving voltage controller to generate the driving voltage by converting the data driving voltage.

The power supply may be configured to activate a first control signal to supply the data driving voltage to the data driver, and a second control signal to supply the driving voltage to the display panel.

The voltage converter may be configured to supply the data driving voltage to the data driver in response to the first control signal, and the driving voltage controller may be configured to supply the driving voltage to the display panel in response to the second control signal.

The second control signal may be activated after the initial driving period during which the first control signal is activated.

The driving voltage controller may include a comparator to compare the voltage of the power supply line with the reference voltage and to generate an output signal corresponding to the compared result, a control transistor to be turned on or turned off depending on the output signal of the comparator, a resistor having a resistance that varies depending on the output signal of the comparator, and a power output unit to output a static voltage to the power supply line, the static voltage being based on a resistance value of the resistor.

The driving voltage controller may further include a sensor coupled to an output end of the comparator, the sensor being configured to sense whether the voltage of the power supply line is greater than the reference voltage based on the output signal of the comparator.

The comparator may be configured to be activated during the initial driving period and be inactivated after the initial driving period.

The comparator may be configured to output a turn-on level signal of the control transistor when the voltage of the power supply line is greater than the reference voltage.

The first control signal may have a logic level corresponding to the output signal of the comparator, and the resistance value of the resistor may correspond to the logic level of the first control signal.

The resistance value of the resistor may cause the power output unit to output the ground voltage to the power supply line.

A method of controlling a driving voltage of a display device including a display panel to display an image, a power supply to supply a driving voltage to the display panel through a power supply line, and a data driver to supply a data signal to the display panel according to another exemplary embodiment includes the steps of supplying a data driving voltage from the power supply to the data driver, sensing a voltage of the power supply line, controlling the power supply to supply a ground voltage to the power supply line in response to the sensing result, and supplying the driving voltage to the power supply line.

The step of controlling of the power supply may include determining the difference between the voltage of the power supply line and a reference voltage, and supplying the ground voltage to the power supply line when the voltage of the power supply line is greater than the reference voltage.

The step of supplying the data driving voltage to the data driver may include activating a first control signal and supplying the data driving voltage to the data driver in response to the first control signal.

The step of supplying the driving voltage to the power supply line may include activating a second control signal after a preset initial driving period during which the first control signal is activated and supplying the driving voltage to the power supply line in response to the second control signal.

The step of supplying the driving voltage to the power supply line may occur after the ground voltage is supplied to the power supply line for a present initial driving period if the voltage sensed in the power supply line is greater than a reference voltage.

The step of supplying the ground voltage to the power supply line may include adjusting a resistance of a variable resistor disposed in the power supply.

The step of sensing the voltage of the power supply line may occur before the step of supplying the driving voltage to the power supply line It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
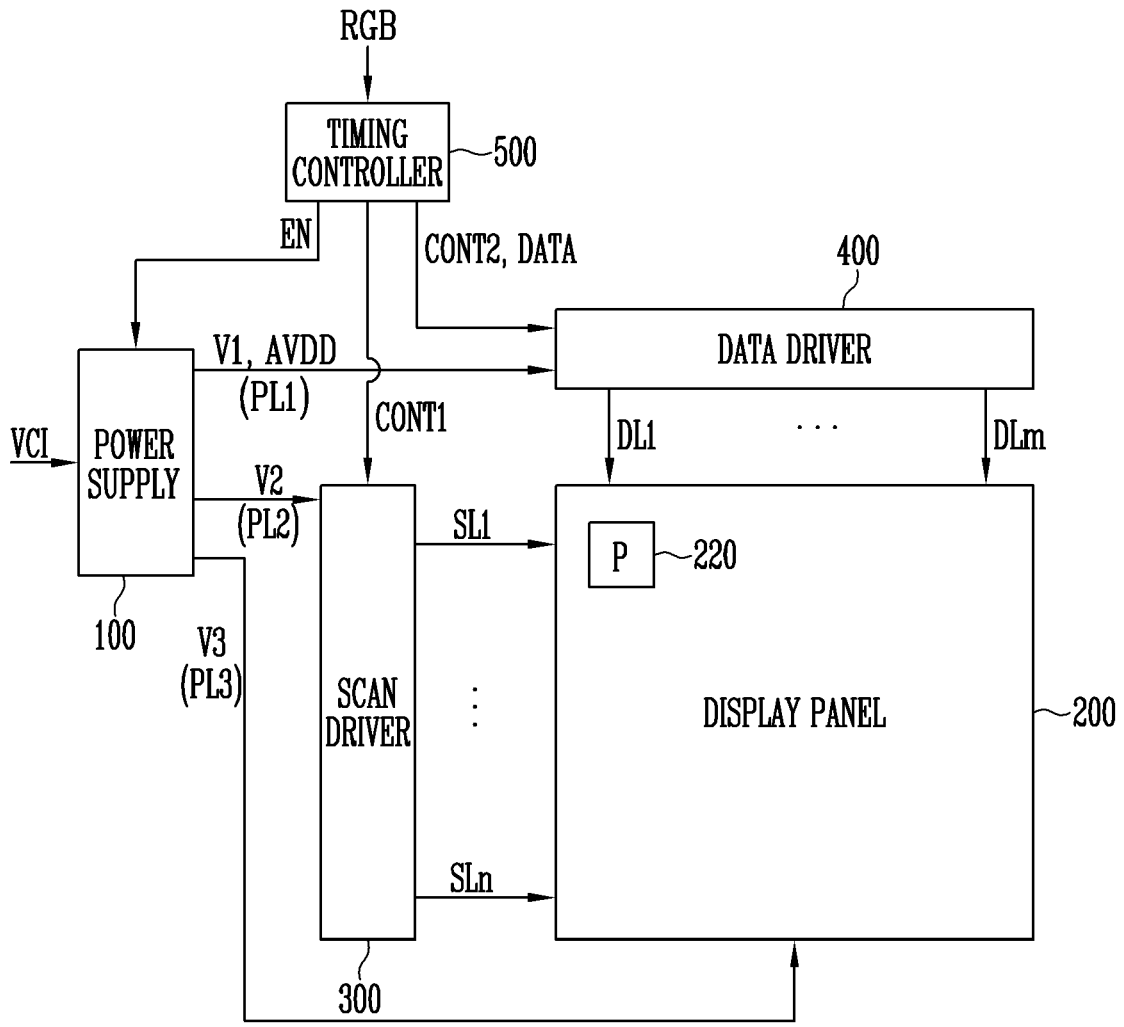
FIG. 1 is a block diagram of an exemplary embodiment of a display device constructed according to the principles of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z—axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2:
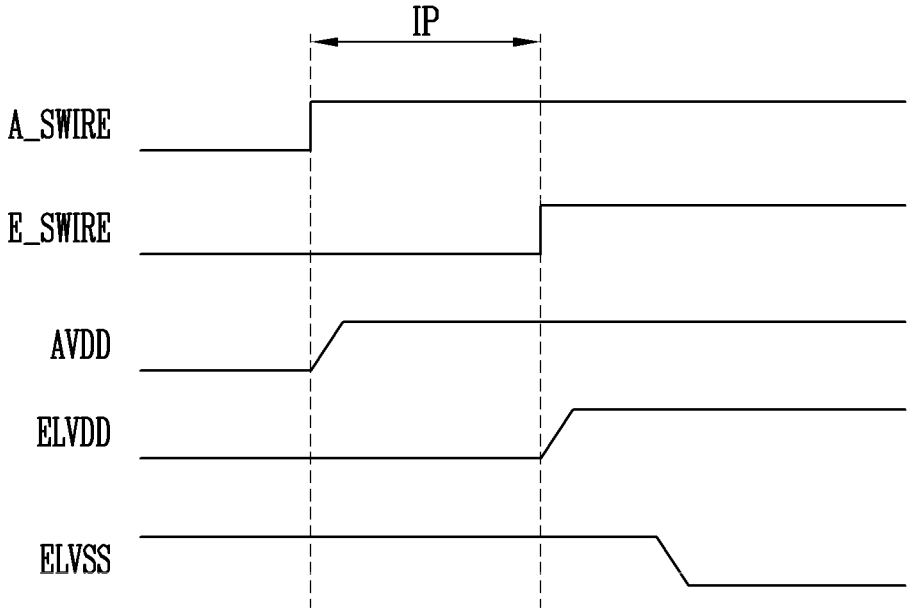
FIG. 2 is a timing diagram exemplarily illustrating a driving method of the display device of FIG. 1.

FIG. 1 is a block diagram of an exemplary embodiment of a display device constructed according to the principles of the invention. FIG. 2 is a timing diagram exemplarily illustrating a driving method of the display device of FIG. 1.

Referring to FIG. 1, the display device may include a power supply 100, a display panel 200, a scan driver 300, a data driver 400, and a timing controller 500.

The power supply 100 may manage the magnitudes and the sequence of driving voltages provided to the display panel 200, the scan driver 300, and the data driver 400. The power supply 100 may convert an externally supplied input voltage VCI into a data driving voltage AVDD for driving the data driver 400, based on an enable signal EN supplied from the timing controller 500. The power supply 100 may also convert the data driving voltage AVDD into driving voltages V1, V2, and V3 respectively provided to the data driver 400, the scan driver 300, and the display panel 200.

In an exemplary embodiment, the power supply 100 may generate a first control signal A_SWIRE and a second control signal E_SWIRE, based on the enable signal EN, and io control the timing at which the data driving voltage AVDD is provided to the data driver 400 and the timings at which the driving voltages V1, V2, and V3 are respectively supplied to the data driver 400, the scan driver 300, and the display panel 200, based on the first control signal A_SWIRE and the second control signal E_SWIRE. For example, when the first control signal A_SWIRE is activated, the power supply 100 may output the data driving voltage AVDD to the data driver 400. When the second control signal E_SWIRE is activated, the power supply 100 may output the driving voltages V1, V2, and V3 to the data driver 400, the scan driver 300, and the display panel 200, respectively, through power supply lines PL1, PL2, and PL3.

The first driving voltage V1 may include, for example, a first gamma voltage and a second gamma voltage, which may be used for driving the data driver 400. In some exemplary embodiments, the first driving voltage V1 may include the highest gamma voltage and the lowest gamma voltage required for driving the data driver 400. The second driving voltage V2 may include, for example, a high DC voltage and a low DC voltage, which may be used for driving the scan driver 300. The third driving voltage V3 may include, for example, a high-potential driving voltage ELVDD, a low-potential driving voltage ELVSS, an initialization voltage, and the like, which may be supplied to pixels 220 included in the display panel 200. In an exemplary embodiment, providing the low-potential driving voltage ELVSS to the display panel 200 may be delayed for a preset time from the time at which the high-potential driving voltage ELVDD is supplied to the display panel 200.

In an exemplary embodiment, the second control signal E_SWIRE may be activated after a preset initial driving period IP from the activation of the first control signal A_SWIRE. The power supply 100 constructed according to the principles of the invention may detect an abnormal state of the display panel 200 during an initialization period, and control the third driving voltage V3 based on the detection result. The operation of the power supply 100 will be described in more detail below with reference to FIGS. 3 to 7.

In an exemplary embodiment, the power supply 100 may receive the data driving voltage AVDD from a separate external voltage source. For example, the display device may further include a battery or a power provider, which supplies the data driving voltage AVDD.

The display panel 200 displays an image. The display panel 200 includes a plurality of scan lines SL1, . . . , and SLn, a plurality of data lines DL1, . . . , and DLm, and a plurality of pixels 220 coupled to the scan lines SL1, . . . , and SLn and the data lines DL1, . . . , and DLm. For example, the pixels 220 may be arranged in a substantially matrix form.

The scan driver 300 may simultaneously or sequentially apply a scan signal to the scan lines SL1, . . . , and SLn of the display panel 200, based on a first control signal CONT1 provided from the timing controller 500 and the second driving voltage V2 provided from the power supply 100. In an exemplary embodiment, the scan driver 300 may include a shift register, a level shifter, an output buffer, etc.

The data driver 400 may convert image data into a data voltage in an analog form, based on a second control signal CONT2 and output image signal DATA, which are provided from the timing controller 500, and the data driving voltage AVDD and the first driving voltage V1, which are provided from the power supply 100, and apply the data voltage to the data lines DL1, . . . , and DLm. In an exemplary embodiment, the data driver 400 may include a gamma block for generating a plurality of gamma voltages and a data driving block for generating a data voltage based on the gamma voltages. The data driving block may include a shift register, a latch block, a digital-analog converter (DAC), an output buffer, etc. In an exemplary embodiment, the data driving voltage may be provided to an output buffer and control an output operation timing of the data driver 400.

The timing controller 500 may receive an input control signal and an input image signal RGB from an image source, such as an external graphic device. The timing controller 500 may generate an output image signal DATA in a digital form, which may be suitable for an operating condition of the display panel 200 based on the input image signal RGB, and provide the output image signal DATA to the data driver 400. The timing controller 500 may also generate the first control signal CONT1 for controlling a driving timing of the scan driver 300 and the second control signal CONT2 for controlling a driving timing of the data driver 400 based on the input control signal, and provide the first control signal CONT1 and the second control signal CONT2 to the scan driver 300 and the data driver 400, respectively. The timing controller 500 may further provide the power supply 100 with the enable signal EN for controlling a driving timing of the power supply 100 based on the input control signal.

Figure 3:
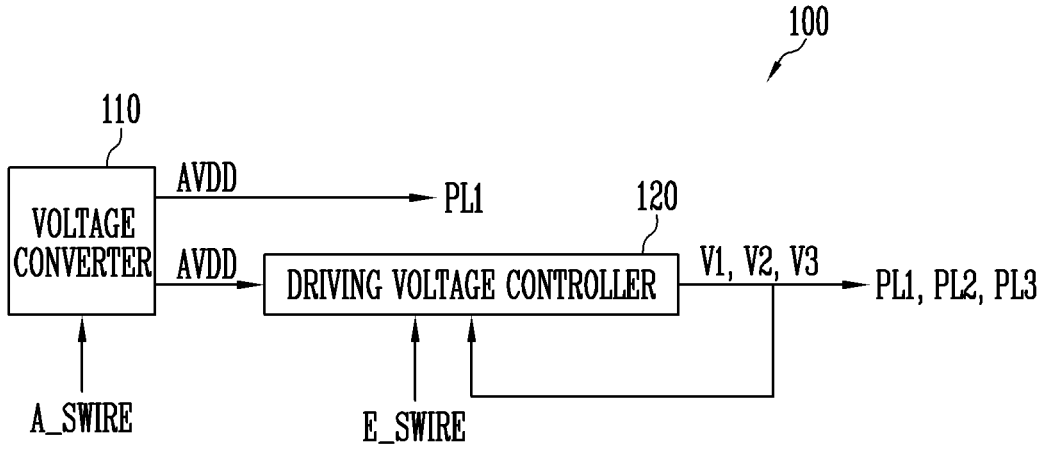
FIG. 3 is a block diagram of an exemplary embodiment of the power supply of FIG. 1.

FIG. 3 is a block diagram of an exemplary embodiment of the power supply of FIG. 1.

Referring to FIG. 3, the power supply 100 according to an exemplary embodiment may include a voltage converter 110 and a driving voltage controller 120.

The voltage converter 110 may convert the input voltage VCI into the data driving voltage AVDD for driving the data driver 400 based on the enable signal EN. To this end, the voltage converter 110 may include a boost DC-DC converter and/or an inverting buck-boost DC-DC converter. The voltage converter 110 may supply the data driving voltage AVDD to the data driver 400 in response to the first control signal A_SWIRE.

The driving voltage controller 120 may generate stabilized driving voltages V1, V2, and V3 from the data driving voltage AVDD, and supply the driving voltages V1, V2, and V3 respectively to the data driver 400, the scan driver 300, and the display panel 200 in response to the second control signal E_SWIRE. To this end, the driving voltage controller 120 may include a plurality of regulators, such as low-dropout regulators.

At least a first group of the regulators may generate a first gamma voltage and a second gamma voltage for the data driver 400 based on the data driving voltage AVDD, and at least a second group of the regulators may generate a high DC voltage and a low DC voltage for the scan driver 300 based on the data driving voltage AVDD. In addition, at least a third group of the regulators may generate the high-potential driving voltage ELVDD and the low-potential driving voltage ELVSS for the display panel 200 based on the data driving voltage AVDD.

The driving voltage controller 120 may detect an abnormal state of the display panel 200, e.g., a short circuit, etc., and control the third driving voltage V3 based on the detection result. In an exemplary embodiment, the driving voltage controller 120 may detect the abnormal state of the display panel 200 during the initial driving period IP.

During the initial driving period IP, the first control signal A_SWIRE is activated such that the data driving voltage AVDD is supplied to the data driver 400, and the second control signal E_SWIRE is inactivated such that the third driving voltage V3 is not supplied to the display panel 200. Since the third driving voltage V3 is not supplied to the display panel 200 during the initial driving period IP, the voltage of the power supply line PL3 through which the third driving voltage V3 is supplied to the display panel 200 should have a low level, e.g., a ground level. However, when a short circuit occurs in the display panel or the power supply line PL3, for example, a voltage having a high level may be detected from the power supply line PL3 during the initial driving period IP.

The driving voltage controller 120 may detect an abnormal state of the display panel 200 by comparing the voltage of the power supply line PL3 during the initial driving period IP with a reference voltage, and control the third driving voltage V3 to be at the ground level from the high potential driving voltage ELVDD, for example, when the abnormal state is detected.

Figure 4:
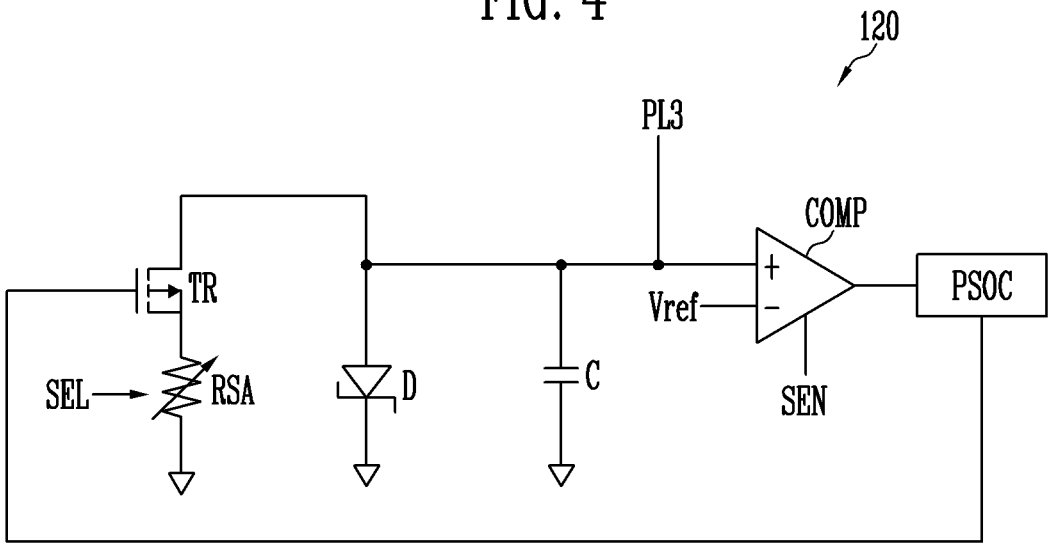
FIG. 4 is a schematic diagram of an exemplary embodiment of the driving voltage controller of FIG. 3.

FIG. 4 is a schematic diagram of an exemplary embodiment of the driving voltage controller of FIG. 3.

Referring to FIG. 4, the driving voltage controller 120 may include a control transistor TR, a variable resistor RSA, a diode D, a comparator COMP, and a determiner PSOC.

The comparator COMP may be coupled to the power supply line PL3 of the display panel 200. In particular, the comparator COMP may be coupled to the power supply line PL3 for supplying the high-potential driving voltage ELVDD to the display panel 200.

The comparator COMP may compare a sensing voltage of the power supply line PL3 with a reference voltage Vref, and output a logic signal according to the comparison result to the determiner PSOC. When an abnormal voltage having the high level is detected from the power supply line PL3 of the display panel 200, the comparator COMP may output a signal corresponding to the difference between the sensing voltage and the reference voltage Vref.

The determiner PSOC may detect an abnormal state of the display panel 200 based on the signal output from the comparator COMP. The determiner PSOC may determine whether the abnormal voltage having the high level has been detected from the power supply line PL3 based on the signal output from the comparator COMP.

The determiner PSOC may feed a signal having a logic level corresponding to the detection result back to the control transistor TR. For example, when an abnormal state of the display panel 200 is detected, the determiner PSOC may output a signal having a turn-on level of the control transistor TR. When the abnormal state is not detected, the determiner PSOC may output a signal having a turn-off level of the control transistor TR.

In an exemplary embodiment, at least one of the comparator COMP and the determiner PSOC may be activated or inactivated based on a sensing enable signal SEN provided from the timing controller 500 or etc. For example, the sensing enable signal SEN may be activated when the first control signal A_SWIRE is activated, and be inactivated when the second control signal E_SWIRE is activated. In particular, the sensing enable signal SEN may be activated during the initial driving period IP to cause the comparator COMP and the determiner PSOC to initiate a sensing operation.

The comparator COMP and the determiner PSOC according to an exemplary embodiment are described as separated units. However, the inventive concepts are not limited thereto. For example, in some exemplary embodiments, the comparator COMP and the determiner PSOC may be formed as one unit, or the determiner PSOC may be omitted. In an exemplary embodiment, a gate electrode of the control transistor TR may be coupled to an output end of the comparator COMP, and the control transistor TR may be turned on or turned off according to the signal output from the comparator COMP.

The control transistor TR may be coupled between the variable resistor RSA and the diode D, and the gate electrode of the control transistor TR may be coupled to the determiner PSOC. The control transistor TR may be turned on or turned off depending on the signal output from the determiner PSOC. For example, when the determiner PSOC outputs the signal having the turn-on level as the abnormal voltage having the high level is detected from the power supply line PL3 of the display panel 200, the control transistor TR may be turned on. When the control transistor TR is turned on, the variable resistor RSA and the diode D may be electrically coupled to each other.

The variable resistor RSA may be coupled between the control transistor TR and a ground voltage. A resistance value of the variable resistor RSA may be determined such that a voltage having the low level, e.g., the ground level is applied to the power supply line PL3 of the display panel 200.

The resistance value of the variable resistor RSA may be controlled by a select signal SEL. In an exemplary embodiment, the select signal SEL may be the first control signal A_SWIRE. The first control signal A_SWIRE may be controlled to be in an activation state during the initial driving period IP. However, when the abnormal state is detected from the power supply line PL3, the resistance value of the variable resistor RSA may be controlled to have a value that corresponds to an arbitrary logic level to control the variable resistance RSA during a preset period.

The resistance value of the variable resistor RSA may be determined as a value corresponding to a logic level of the first control signal A_SWIRE. For example, when the logic level of the first control signal A_SWIRE is 00, the variable resistor RSA may be controlled to have 50 Ω. When the logic level of the first control signal A_SWIRE is 01, the variable resistor RSA may be controlled to have 100 Ω. When the logic level of the first control signal A_SWIRE is 10, the variable resistor RSA may be controlled to have 150 Ω. When the logic level of the first control signal A_SWIRE is 11, the variable resistor RSA may be controlled to have 200 Ω.

The diode D is a voltage output unit, and may include a zener diode. When the control transistor TR is turned on, the diode D is electrically coupled to the variable resistor RSA to supply a static voltage having a preset magnitude to the power supply line PL3 of the display panel 200. In an exemplary embodiment, when the resistance value of the variable resistor RSA is controlled by the first control signal A_SWIRE during the initial driving period IP, a voltage having the ground level may be supplied to the power supply line PL3 of the display panel 200.

Additionally, the driving voltage controller 120 may further include a capacitor C coupled between the power supply line PL3 of the display panel 200 and the ground voltage. The capacitor C may remove an AC noise or ripple, which may occur due to a change in output voltage of the driving voltage controller 120.

Figure 5:
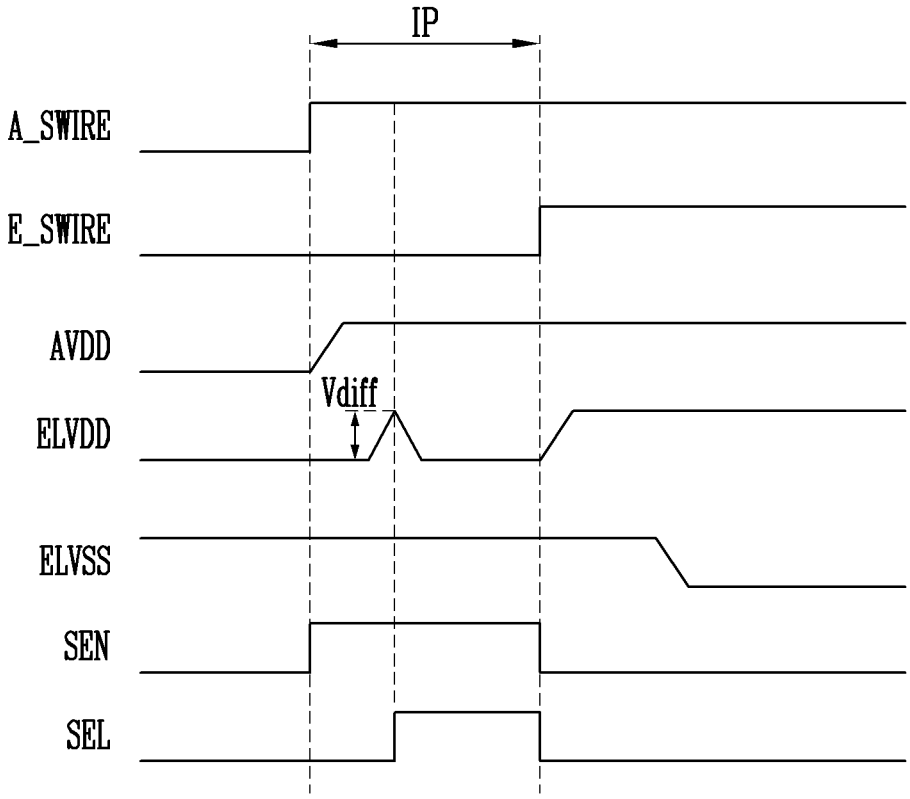
FIG. 5 is a timing diagram exemplarily illustrating a method of controlling the driving voltage of the power supply of FIG. 3.

FIG. 5 is a timing diagram exemplarily illustrating a method of controlling the driving voltage of the power supply of FIG. 3.

Referring to FIGS. 3 to 5, during the initial driving period IP, in which the first control signal A_SWIRE is activated and the second control signal E_SWIRE is inactivated, the data driving voltage AVDD may be supplied to the display panel 200.

When the sensing enable signal SEN is activated during the initial driving period IP, the comparator COMP and the determiner PSOC of the power supply 100 may be activated. The comparator COMP and the determiner PSOC may perform voltage sensing on the power supply line PL3 of the display panel 200.

When a voltage having a greater level than the reference voltage Vref is detected from the power supply line PL3 of the display panel 200, the power supply 100 may allow a voltage having the ground level to be output to the power supply line PL3 of the display panel 200, by controlling a resistance value of the variable resistor RSA, based on the select signal SEL. In an exemplary embodiment, the select signal SEL may have a logic level for determining the resistance value of the variable resistor RSA, corresponding to the difference Vdiff between the reference voltage Vref and the detected voltage.

In an exemplary embodiment, the above-described voltage stabilization process is performed on the high-potential driving voltage ELVDD. More particularly, when a voltage having a level greater than the reference voltage Vref is detected from a power supply line PL3 that supplies the high-potential driving voltage ELVDD, the power supply 100 may stabilize the high-potential driving voltage ELVDD by supplying the voltage having the ground level to the corresponding power supply line PL3.

As described above, when the second control signal E_SWIRE is activated after the voltage stabilization is performed during the initial driving period IP, the high-potential driving voltage ELVDD and the low-potential driving voltage ELVSS may be sequentially supplied to the display panel 200.

When the initial driving period IP ends from the activation of the second control signal E_SWIRE, the sensing enable signal SEN may be inactivated, and the comparator COMP and the determiner PSOC may be inactivated.

Figure 6:
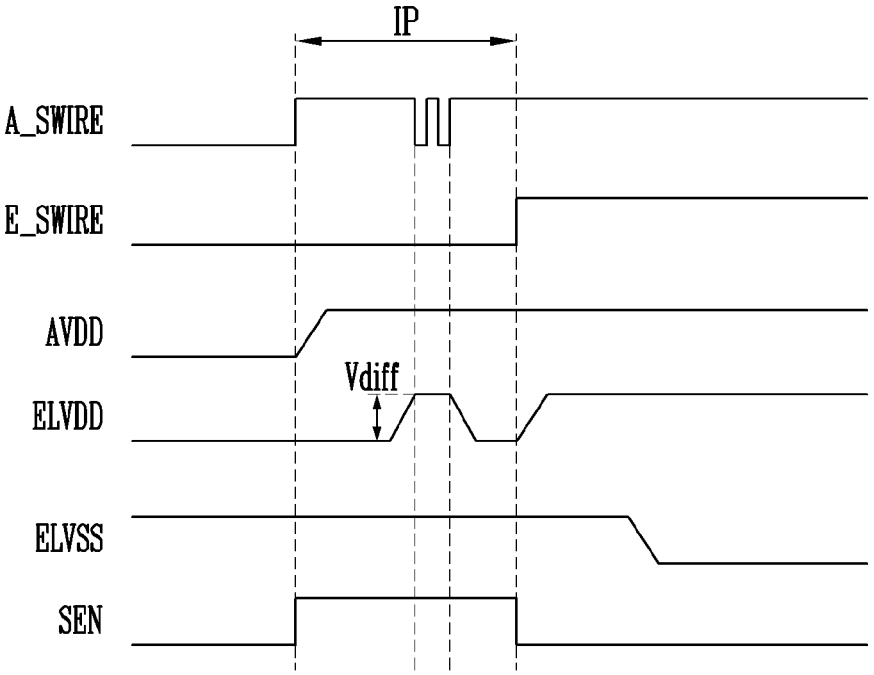
FIG. 6 is a timing diagram exemplarily illustrating another method of controlling the driving voltage of the power supply of FIG. 3.

FIG. 6 is a timing diagram exemplarily illustrating another method of controlling the driving voltage of the power supply of FIG. 3.

Referring to FIGS. 3, 4, and 6, during the initial driving period IP, in which the first control signal A_SWIRE is activated and the second control signal E_SWIRE is inactivated, the data driving voltage AVDD may be supplied to the display panel 200.

When the sensing enable signal SEN is activated during the initial driving period IP, the comparator COMP and the determiner PSOC of the power supply 100 may be activated. The comparator COMP and the determiner PSOC may perform voltage sensing on the power supply line PL3 of the display panel 200.

When a voltage having a level greater than the reference voltage Vref is detected from the power supply line PL3 of the display panel 200, the power supply 100 determines a resistance value of the variable resistor RSA by controlling the first control signal A_SWIRE. The first control signal A_SWIRE may be controlled to output a logic level that determines the resistance value of the variable resistor RSA to correspond to the difference Vdiff between the reference voltage Vref and the detected voltage.

For example, FIG. 6 exemplarily illustrates a case when the first control signal A_SWIRE is output to have the logic level 00. When the logic level of the first control signal A_SWIRE is 00, the variable resistor RSA may be controlled to have 50 Ω. In another exemplary embodiment, when the logic level of the first control signal A_SWIRE is 01, the variable resistor RSA may be controlled to have 100 Ω. When the logic level of the first control signal A_SWIRE is 10, the variable resistor RSA may be controlled to have 150 Ω. When the logic level of the first control signal A_SWIRE is 11, the variable resistor RSA may be controlled to have 200 Ω.

When the resistance value of the variable resistor RSA is controlled, the voltage having the ground level may be output to the power supply line PL3 of the display panel 200.

As described above, when the second control signal E_SWIRE is activated after voltage stabilization on the power supply line PL3 of the display panel 200 is performed during an initial driving period IP, the high-potential driving voltage ELVDD and the low-potential driving voltage ELVSS may be sequentially supplied to the display panel 200.

When the initial driving period IP ends after the activation of the second control signal E_SWIRE, the sensing enable signal SEN may be inactivated, and the comparator COMP and the determiner PSOC may be inactivated.

Figure 7:
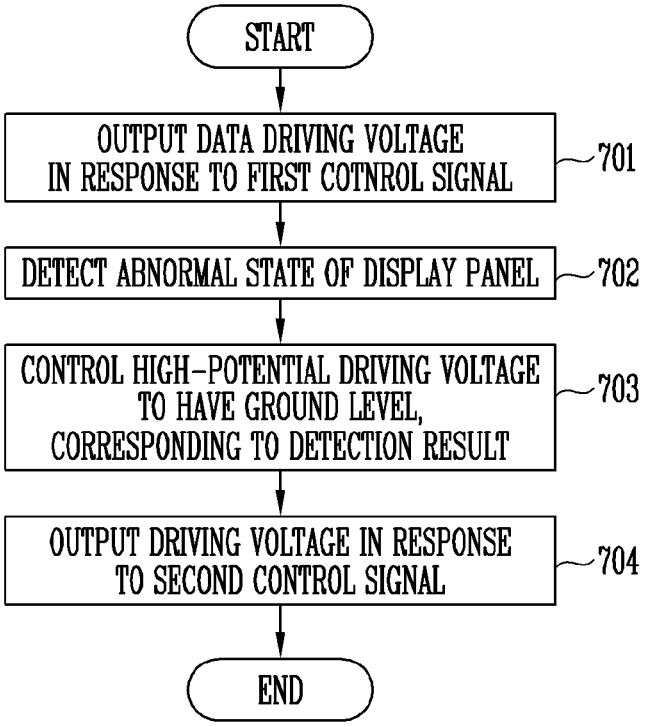
FIG. 7 is a flowchart illustrating an exemplary method of controlling a driving voltage according to the principles of the invention.

FIG. 7 is a flowchart illustrating an exemplary method of controlling a driving voltage according to the principles of the invention.

Referring to FIG. 7, at step 701, the power supply 100 of the display device may output the data driving voltage AVDD in response to the first control signal A_SWIRE. The output data driving voltage AVDD may be provided to the data driver 400 of the display device.

Next, at step 702, the power supply 100 may detect an abnormal state of the display panel 200.

More particularly, the power supply 100 may measure a voltage of the power supply line PL3 that is configured to supply the third driving voltage V3 to the display panel 200. For example, the power supply 100 may measure a voltage of the power supply line PL3 that supplies the high-potential driving voltage ELVDD as the third driving voltage V3. When the measured voltage has a level greater than the reference voltage Vref, the power supply 100 may determine that an abnormal state, such as a short circuit, has occurred in the display panel 200.

Next, at step 703, the power supply 100 may control the high-potential driving voltage ELVDD to have the ground level in accordance with the detected result.

The power supply 100 controls a resistance value of the variable resistor RSA based on the select signal SEL, so that a voltage having the ground level is output to the power supply line PL3. Accordingly, the high-potential driving voltage ELVDD of the display panel 200 can be controlled to have the ground level.

Next, at step 704, the power supply 100 may output the driving voltages V1, V2, and V3 in response to the second control signal E_SWIRE. The output driving voltages V1, V2, and V3 may be respectively provided to the data driver 400, the scan driver 300, and the display panel 200. The third driving voltage V3 provided to the display panel 200 may include the high-potential driving voltage ELVDD and the low-potential driving voltage ELVSS.

As described above, according to exemplary embodiments, an abnormal state of the display panel may be detected during the initial driving period before the driving voltage V3 is provided to the display panel 200, and the driving voltage is controlled to prevent abnormal light emission in the display panel 200 during an initial driving period thereof.

According to exemplary embodiments, an abnormal state of the display panel can be effectively detected in an initial driving period of the display panel. Further, a driving voltage is controlled based on the detection result of an abnormal state during an initial driving period, such that occurrence of abnormal light emission when the display panel is initially driven may be prevented.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a display panel to display an image;

a data driver to supply a data signal to the display panel; and a power supply to supply a driving voltage to the display panel through a power supply line and to supply a data driving voltage to the data driver, wherein the power supply is configured to detect a voltage of the power supply line during an initial driving period during which the data driving voltage is supplied to the data driver, to supply a ground voltage to the display panel when the voltage detected from the power supply line is different from a reference voltage, and to supply the driving voltage to the power supply line after the initial driving period.

2. The display device of claim 1, wherein the power supply comprises:

a voltage converter to generate the data driving voltage by converting an external input voltage; and a driving voltage controller to generate the driving voltage by converting the data driving voltage.

3. The display device of claim 2, wherein the power supply is configured to activate:

a first control signal to supply the data driving voltage to the data driver; and a second control signal to supply the driving voltage to the display panel.

4. The display device of claim 3, wherein:

the voltage converter is configured to supply the data driving voltage to the data driver in response to the first control signal; and the driving voltage controller is configured to supply the driving voltage to the display panel in response to the second control signal.

5. The display device of claim 3, wherein the second control signal is activated after the initial driving period during which the first control signal is activated.

6. The display device of claim 5, wherein the driving voltage controller comprises:

a comparator to compare the voltage of the power supply line with the reference voltage and to generate an output signal corresponding to the compared result;

a control transistor to be turned on or turned off depending on the output signal of the comparator;

a resistor having a resistance that varies depending on the output signal of the comparator; and a power output unit to output a static voltage to the power supply line, the static voltage being based on a resistance value of the resistor.

7. The display device of claim 6, wherein the driving voltage controller further includes a sensor coupled to an output end of the comparator, the sensor being configured to sense whether the voltage of the power supply line is greater than the reference voltage based on the output signal of the comparator.

8. The display device of claim 6, wherein the comparator is configured to be activated during the initial driving period and be inactivated after the initial driving period.

9. The display device of claim 6, wherein the comparator is configured to output a turn-on level signal of the control transistor when the voltage of the power supply line is greater than the reference voltage.

10. The display device of claim 6, wherein:

the first control signal has a logic level corresponding to the output signal of the comparator; and the resistance value of the resistor corresponds to the logic level of the first control signal.

11. The display device of claim 6, wherein the resistance value of the resistor causes the power output unit to output the ground voltage to the power supply line.

12. A method of controlling a driving voltage of a display device including a display panel to display an image, a power supply to supply a driving voltage to the display panel through a power supply line, and a data driver to supply a data signal to the display panel, the method comprising the steps of:

supplying a data driving voltage from the power supply to the data driver;

sensing a voltage of the power supply line during an initial driving period during which the data driving voltage is supplied to the data driver;

controlling the power supply to supply a ground voltage to the power supply line when the voltage of the power supply line is determined to be different from a reference voltage; and supplying the driving voltage to the power supply line after the initial driving period.

13. The method of claim 12, wherein the step of controlling of the power supply includes:

determining the difference between the voltage of the power supply line and the reference voltage; and supplying the ground voltage to the power supply line when the voltage of the power supply line is greater than the reference voltage.

14. The method of claim 13, wherein the step of supplying the data driving voltage to the data driver includes:

activating a first control signal; and supplying the data driving voltage to the data driver in response to the first control signal.

15. The method of claim 14, wherein the step of supplying the driving voltage to the power supply line includes:

activating a second control signal after the initial driving period; and supplying the driving voltage to the power supply line in response to the second control signal.

16. The method of claim 12, wherein the step of supplying the driving voltage to the power supply line occurs after the ground voltage is supplied to the power supply line for the initial driving period if the voltage sensed in the power supply line is greater than a reference voltage.

17. The method of claim 16, wherein the step of supplying the ground voltage to the power supply line includes adjusting a resistance of a variable resistor disposed in the power supply.

18. The method of claim 12, wherein the step of sensing the voltage of the power supply line occurs before the step of supplying the driving voltage to the power supply line.

* * * * *